United States Patent [19]

Zeigler

[11] Patent Number: 4,579,066

[45] Date of Patent: Apr. 1, 1986

[54] KNOCK-DOWN TABLE

[76] Inventor: Theodore R. Zeigler, 205 S. Columbus St., Alexandria, Va. 22314

[21] Appl. No.: 511,011

[22] Filed: Jul. 5, 1983

[51] Int. Cl.[4] ..... A47B 3/06

[52] U.S. Cl. ..... 108/157; 108/112; 108/115; 248/166

[58] Field of Search ..... 108/157, 153, 115, 65, 108/111, 112; 248/165, 166, 436; 52/109

[56] References Cited

U.S. PATENT DOCUMENTS

| | | | |
|---|---|---|---|
| 683,264 | 9/1901 | Flemister | 108/157 |
| 880,525 | 3/1908 | Hazzard | 108/157 X |
| 1,126,250 | 1/1915 | Moller | 108/157 |
| 2,638,394 | 5/1953 | Ulrich | 108/157 X |
| 3,968,808 | 7/1976 | Zeigler | 52/109 X |
| 4,276,726 | 7/1981 | Derus | 248/166 X |
| 4,341,164 | 7/1982 | Johnson | 108/157 X |

*Primary Examiner*—Philip C. Kannan
*Attorney, Agent, or Firm*—John P. Snyder

[57] ABSTRACT

This disclosure relates to a knock-down table formed by a pair of frames each constructed from a plurality of pivotally interconnected rods with each frame being foldable from a collapsed inoperative condition to an erected operative condition in generally spaced upstanding adjacent relationship to each other, the frames being self-locking and having upper pairs of corners at which rings are pivotally connected to selected ones of the rods, a pair of rails spanning the frames and including male connectors for insertion in innermost adjacent ones of the rings to thereby connect the frames and lend stability thereto, at least one additional rail spanning outer corners of each frame for further stability, and a planar supporting sheet supported generally atop and in spanning relationship to the rails to provide a table top for supporting articles thereupon.

27 Claims, 7 Drawing Figures

KNOCK-DOWN TABLE

The present invention is directed to a novel knock-down support, particularly a knock-down table, and several of the components thereof are modules or substructures of other commonly assigned inventions of Theodore R. Zeigler, as, for example, those components, modules or substructures disclosed in U.S. Pat. Nos. 4,280,521 entitled Hub Assembly for Collapsible Structures which issued July 28, 1981; 4,290,244 entitled Collapsible Self-Supporting Structures and Panels and Hub Therefor which issued Sept. 22, 1981; 4,026,313 entitled Collapsible Self-Supporting Structures issued May 31, 1971; and 3,968,808 entitled Collapsible Self-Supporting Structures which issued July 13, 1976.

In accordance with the present invention, two assemblies or frames corresponding to FIG. 10 of U.S. Pat. No. 4,290,244 are disposed in side-by-side upstanding erected condition and a plurality of rails are connected to rings or hubs at upper corners of the frames by male fastening elements thereby imparting a general rectangular outline to the structure which serves as a knock-down support susceptible to a variety of different functions, particularly a table upon spanning the rails with a suitable planar sheet material support surface or table top.

In further accordance with this invention, another object is that of providing selected ones of the rails with axially aligned and oppositely directed male connecting elements which engage in innermost or adjacent rings or hubs of the frames and/or provide ends of the rails with male elements in the form of hooks which engage pintles carried by separate connectors which are in turn connected to outermost or remote hubs or rings of the frames.

Still another object of this invention is to provide a novel knock-down supportor table as aforesaid including a plurality of additional stabilizing rails connected to and spanning the distance between the rails carrying the male connecting elements to lend further stability to the knock-down table and also function to confiningly locate the table top or planar support in operative position atop and in generally spanning relationship to the rails.

Still another object of this invention is to provide a novel knock-down support or table as aforesaid wherein the table top is preferably constructed from a plurality of narrow parallel strips joined by a flexible sheet to permit the table top to be rolled and unrolled as required.

With the above and other objects in view that will hereinafter appear, the nature of the invention will be more clearly understood by reference to the following detailed description, the appended claims and the several views illustrated in the accompanying drawings.

IN THE DRAWINGS

FIG. 4 is a cross-sectional view taken generally along line 4—4 of FIG. 3, and illustrates additional details of one of the frames.

Figure 5:
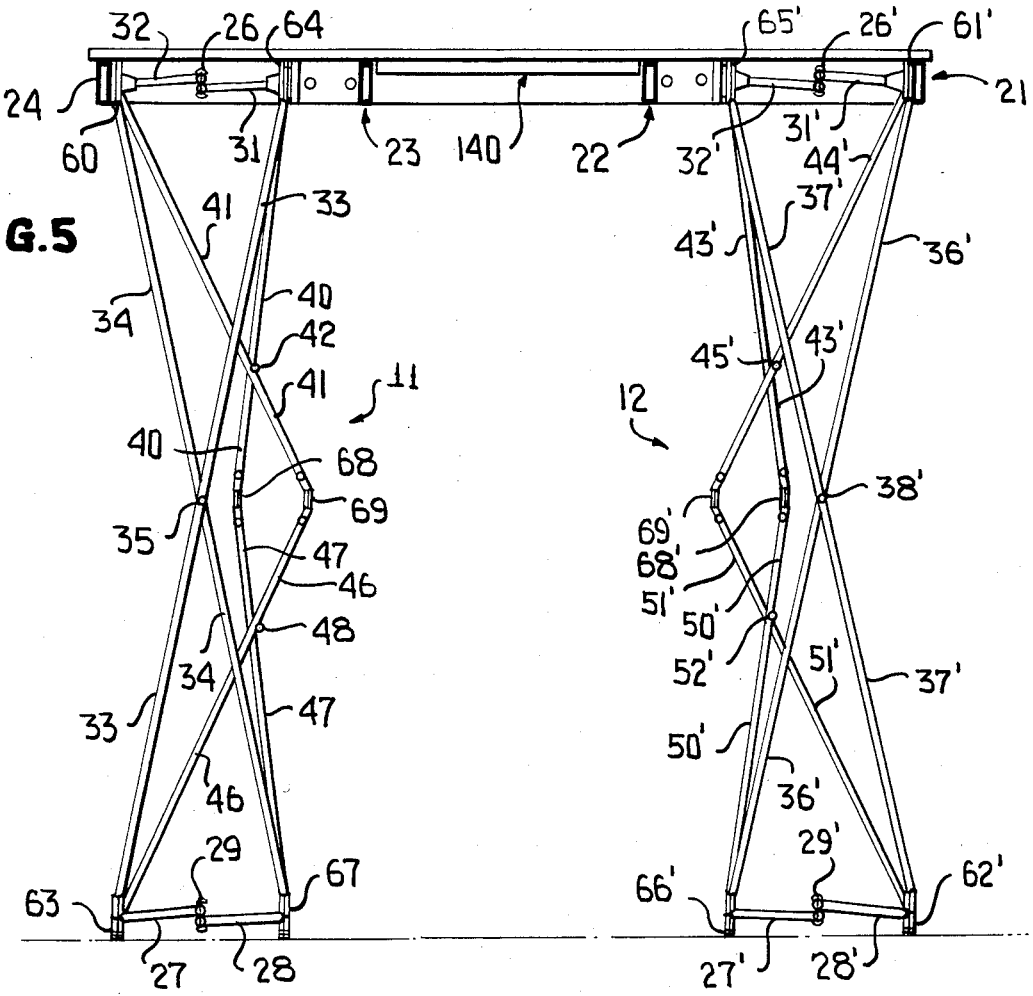
FIG. 5 is a sectional view taken generally along line 5—5 of FIG. 4, and illustrates the manner in which the frames are disposed in side-by-side spaced relationship while being interconnected and stabilized at the top by the rails.
Figure 7:
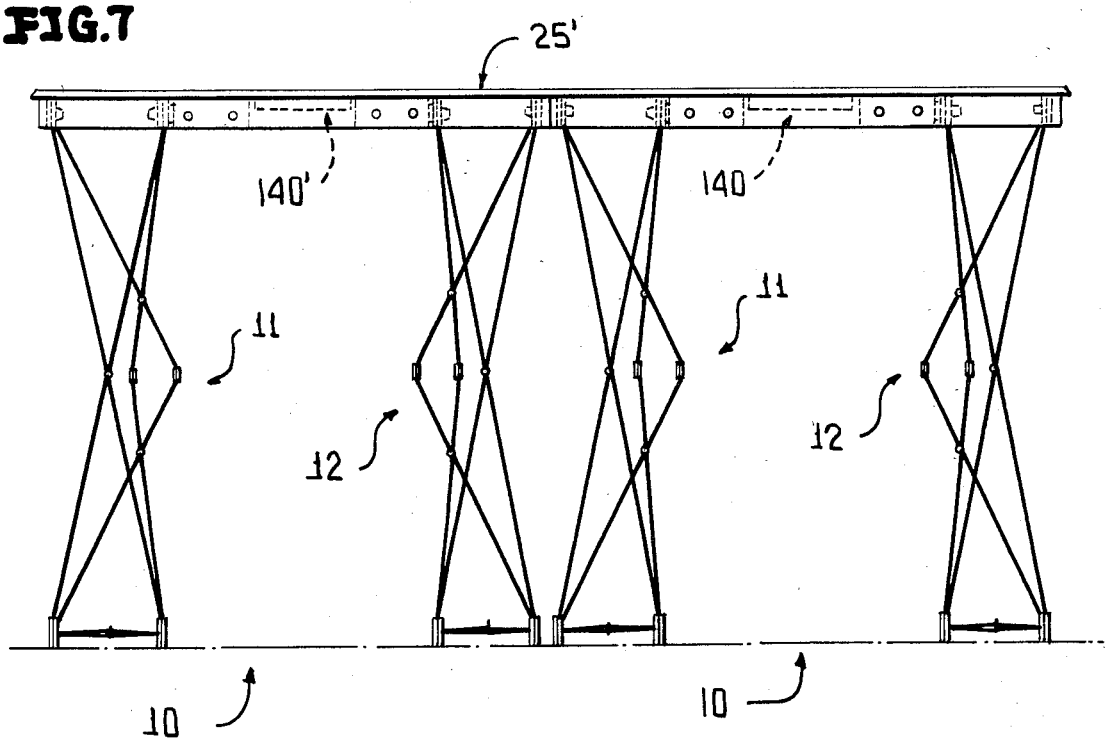

FIG. 7 which appears on the sheet of drawings containing FIG. 5, illustrates two of the knock-down tables of FIGS. 2 through 5 positioned side-by-side and spanned by a single table top.

Figure 1:
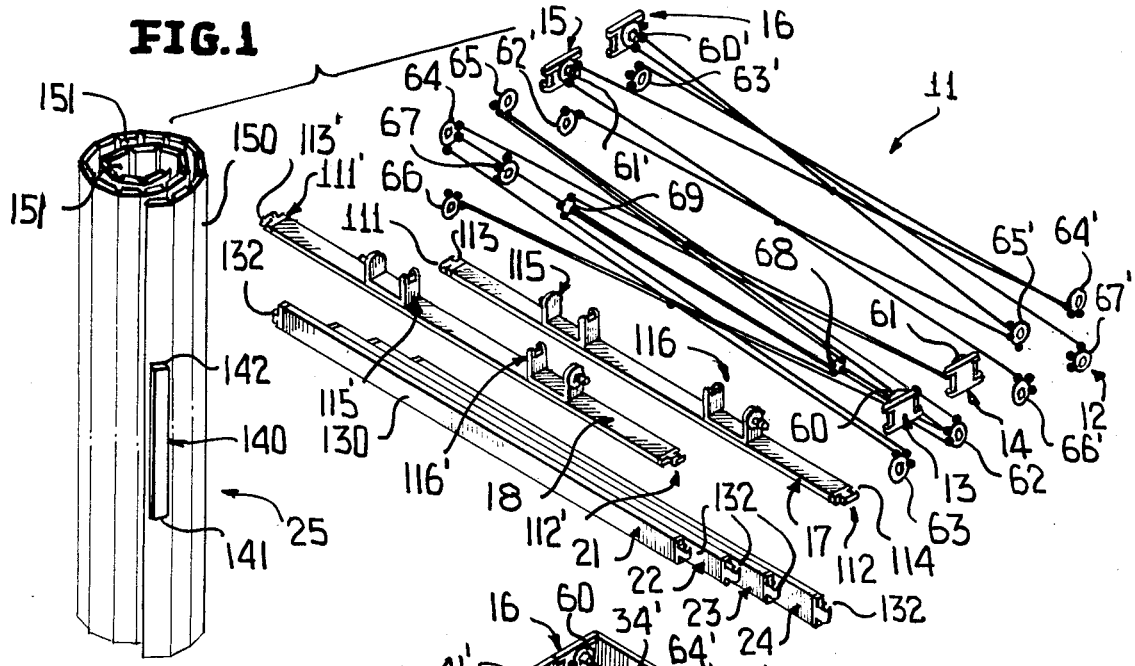
FIG. 1 is a perspective view of a knock-down support or table constructed in accordance with this invention, and illustrates the various components, namely, two frames each carrying two connectors, two rails carrying male and female connecting elements, four rails carrying male connecting elements, and a rolled-up top.

A novel knock-down support or table is generally designated by the reference numeral 10 (FIGS. 2 through 5), and is formed from a plurality of components shown in their disassembled condition in FIG. 1.

The components of the knock-down support or table 10, as shown in FIG. 1, include two identical frames 11, 12 carrying respective connectors 13, 14 and 15, 16; two identical rails 17 and 18; four identical rails 21 through 24; and a rolled-up table top 25. The frames 11, 12 are illustrated in FIG. 1 in their collapsed inoperative condition, and each can be set up to their erected operative self-supporting condition (FIG. 2) incident to connecting the rails 17, 18 and 21 through 24 thereto to form the knock-down support upon which is unrolled the top 25 to form the knock-down table 10 of FIGS. 2 through 5.

Inasmuch as the frames 11, 12 are identical, the following description of the frame 11 is applicable to the frame 12 and like numerals have been applied to the frame 12 as those applied to the frame 11 excpet the same have been primed to indicate identity of structure.

The frame, assembly or section 11 includes a bottom horizontally disposed pair of cross rods, rod elements or tubes 27, 28 pivotally connected at 29; a top pair of crossed rods, rod elements or tubes 31 or 32 likewise pivoted to each other at 26; a pair of vertical crossed rods, rod elements or tubes 33, 34 pivotally interconnected by a pivot path 35, and another pair of vertical crossed rod, rod elements or tubes 36, 37 pivotally connected at a pivot pin 38.

Four other pairs of crossed rods, rod elements or tubes are also pivotally interconnected, namely, the rods 40, 41 pivotally connected at 42; the rods 43, 44 pivotally connected at 45; the rods 46, 47 pivotally connected at 48; and the rods 50, 51 pivotally connected at 52.

Figure 3:
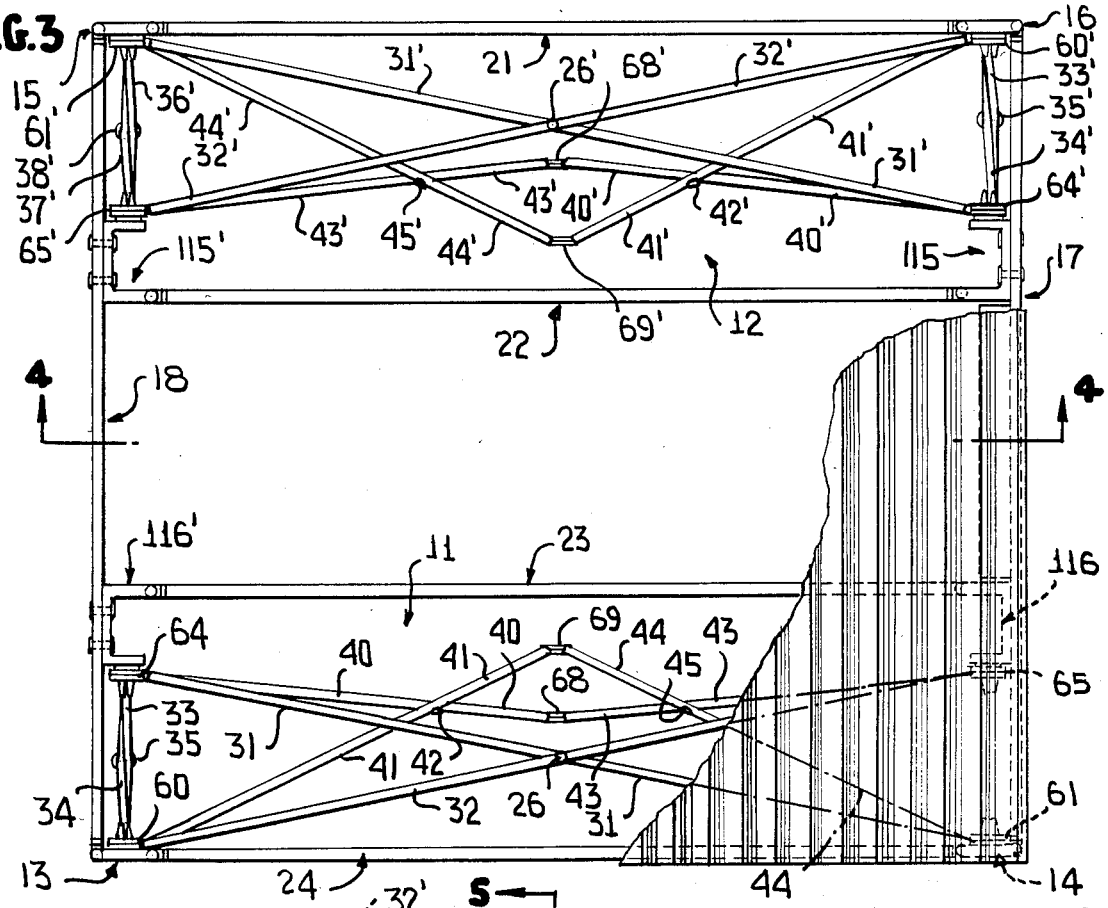
FIG. 3 is a top plan view of the knock-down support or table, and illustrates the manner in which the rails are interconnected to each other and to the erected frames.

The rods are also connected to associated hubs 60 through 69 with details of the construction of these hubs and their pivotal connection to the associated rods being best illustrated in U.S. Pat. No. 4,280,521 (FIGS. 3 and 5).

The hubs 60, 61, 62 and 63 lie in an essentially common plane in the erected condition of the section 11 as do the hubs 64, 65, 66 and 67. Thus, the planes of the hubs 60 through 63 and the hubs 64 through 67 are generally spaced and in parallel relationship to each other, as is most evident from FIG. 3 of the drawings. The hubs 60, 61, 62 and 63 are also in front and in axial alignment with the respective hubs 64, 65, 66 and 67. All of the hubs 60 through 67 are generally annular shaped or define a ring having a central opening O. The hubs 68, 69 are circular, do not have an opening O, and are somewhat of a smaller diameter than the diameter of the hubs 60 through 67. The hub 68 is, however, forward of and in axial alignment with the hub 69.

The rods 33, 34 are connected at their uppermost ends (FIG. 2) to the respective hubs 64, 60, and at their lower ends to the respective hubs 63, 67.

The rods 27, 28 are connected at their left ends (FIG. 2) to the respective hubs 63, 67 and to the hubs 66, 62, respectively, at the right-hand ends of these same rods.

The rods 36, 37 are connected at their lower ends, again in FIG. 1, to the hubs 66, 62, respectively, and at their upper ends to the hubs 61, 65, respectively.

The rods 31, 32 are connected at their left-hand ends to the hubs 64, 60, respectively, and at their right-hand ends to the hubs 61, 63, respectively.

The latter connections impart an overall generally polygonal or square-shaped configuration to the overall frame 11 and, of course, to the remaining frame 12.

Reference is now made to the centermost or internal four pairs of crossed rods which all have ends at the hubs 68, 69.

The rods 40, 41 are connected at their uppermost ends to the respective ends 64, 60 (FIG. 2) and at their lowermost ends to the hubs 68, 69.

The rods 50, 51 are connected at their lowermost ends to the respective hubs 66, 62 and at their uppermost ends to the respective hubs 68, 69.

The rods 43, 44 are connected at their upper ends to the respective hubs 65, 66, and at their lower ends to the hubs 68, 69.

The rods 46, 47 are connected at their lower ends to the respective hubs 63, 67 and at their upper ends to the hubs 69, 68.

By virtue of the latter-noted construction of the frame 11, as well as the identical frame 12 to which like numerals (though primed) have been added (as earlier noted), the various rods interact when the frames 11, 12 are moved from their collapsed position (FIG. 1) to their erected position (FIGS. 2 through 5) such as to place the frames 11, 12 under cumulative self-locking stress to hold the frames 11, 12 in their erected condition (FIGS. 2 through 5). When the cumulative self-locking stresses are released by essentially progressively manipulating the hubs 68, 69 and 68' 69' to progressively spread the same further apart, the sections 11, 12 automatically release and unlock and the frames collapse to their collapsed position (FIG. 1). It is, of course, in the erected position (FIGS. 2 through 5) in which the frames 11 and 12 form components of the overall knock-down support or table 10. In the set-up or erected operative condition of the frames 11, 12, the same are preferably positioned such that their respective hubs 69, 69' are in adjacent aligned relationship which places the hubs 64, 65, 66 and 67 of the frame 11 in adjacent opposing relationship to the hubs 65', 64', 67' and 66', respectively, of the frame 12, as is best illustrated in FIGS. 2 through 5 of the drawings. However, the frames 11, 12 can as well be positioned with the hubs 69, 69', respectively, remote from each other which would then positioned the hubs more outboard toward the periphery of the overall support 10 than that shown best in FIG. 3. However, in keeping with this invention it makes no difference whether the hubs 68, 68', 69 and 69' are inboard or outboard, and it is further immaterial as to the particular pairs of corners which are uppermost or lowermost in the set-up or erected condition of the knock-down support 10.

Reference is made specifically to FIG. 1 which illustrates the connectors or connecting means 13, 14 secured to the respective hubs 60, 61 of the frame 11 and identical connectors or connecting means 15, 16 connected to the respective hubs 61', 60' of the frame 12. While the identical connectors 13 through 16 can be connected to other of the hubs of both frames 11, 12, limited only that such hubs form the outermost and uppermost corners of each frame, the connectors 13 through 16 have been illustrated specifically to the hubs noted so that it can be readily observed that as the frame 11 is moved from the collapsed position (FIG. 1) to the erected position (FIG. 2), the connectors 13, 14 will occupy the uppermost, outermost and respective left and right corners of the support 10, as viewed in FIG. 2. Likewise, when the frame 12 is moved from its collapsed position (FIG. 1) to its erected condition (FIG. 2), the connectors 15, 16 will occupy the uppermost, outermost and respective left and right corners, as viewed in FIG. 2, of the frame 12.

Figure 6:
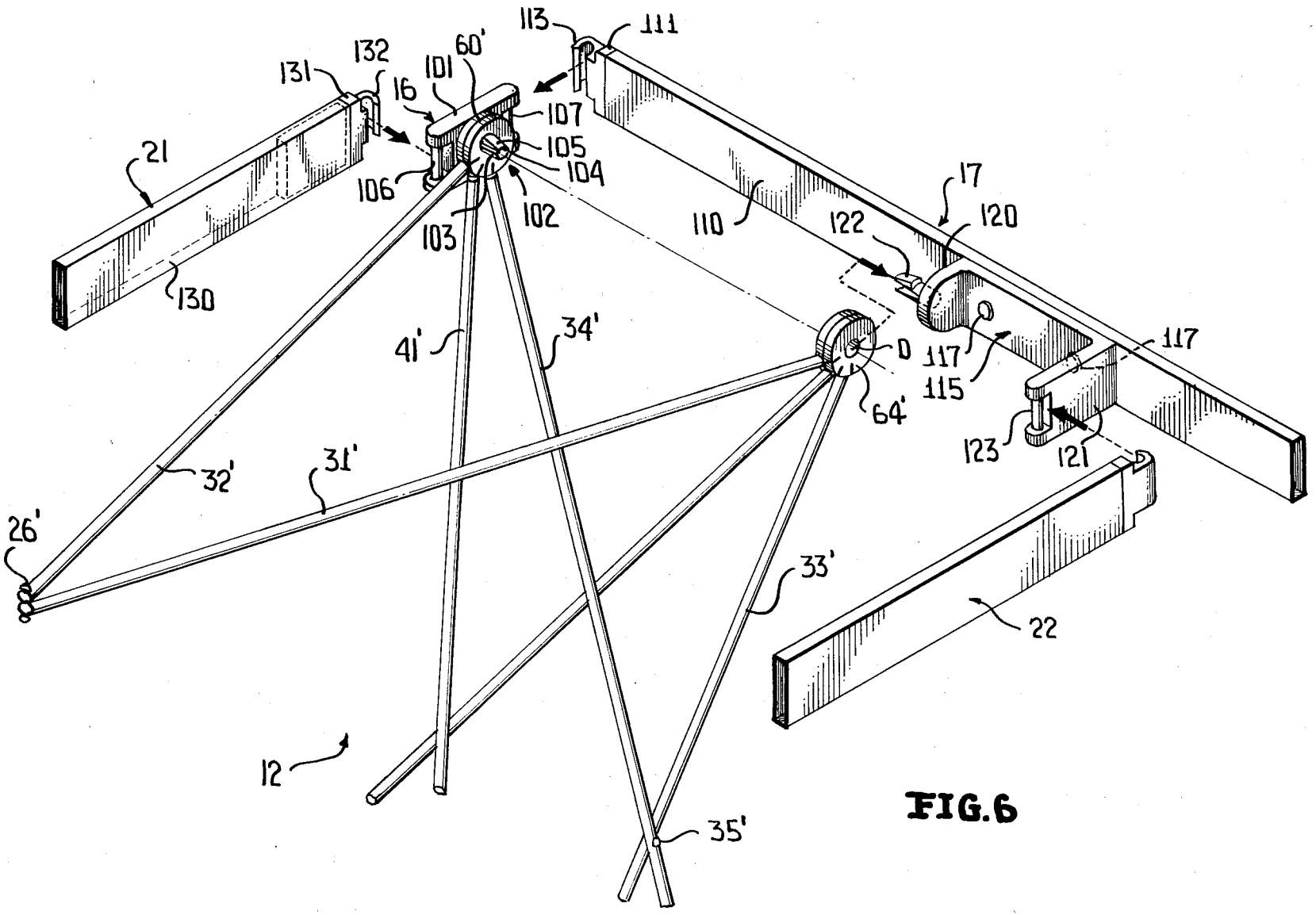
FIG. 6 is an exploded perspective view of a corner of one of the frames, and illustrates the manner in which several rails are connected thereto and to each other.

The connectors or connection means 13 through 16 are identical and, hence, the following description of the connectors 16 will suffice for a complete understanding of the present invention and is equally applicable to the remaining connectors to which like, though primed, numerals have been applied. The connectors 16 constitutes a removable connecting means which corresponds generally to the clip best shown in FIG. 24 of application Ser. No. 409,435 in the name of Theodore R. Zeigler filed Aug. 19, 1982, entitled Clip for Self-Locking Collapsible/Expandable Structures and now U.S. Pat. No. 4,522,008. However, the clip or connecting means 16 includes a body 101 (FIG. 6) centrally of which projects a stem or projection 102 which is bifurcated, as at 103, 104, and each bifurcated portion 103, 104 includes a locking lug or a shoulder 105. The stem or projection 102 thereby functions as a male locking element and is received in the opening O of the hub 60' to removably secure the clip or connector 101 thereto. The connector 101 further includes two pintles or trunions 106, 107 to which can be removably fastened hooks of the associated rails 17, 18 and 21 through 24, as will be described more fully hereinafter. In the latter manner, the hub 16 is removably secured by its stem or projection 102 to the hub 60', while the remaining connectors 13, 14 and 15 are likewise secured by their respective projections or stems to the respective hubs 60, 61 and 61'.

The rails 17, 18 are identical and the following description of the rail 17 is equally applicable to the rail 18 to which like, though primed, reference numerals have been applied. The rails 17 (FIGS. 2 and 6) includes a tubular hollow bar 110 of a generally rectangular cross-sections into opposite ends of which are inserted plastic inserts 111, 112 having respective hooks 113, 114 facing or opening in the same direction. A pair of generally U-shaped brackets 115, 116 are secured by fastening means or rivets 117 (FIG. 6) to the rail 17. The brackets 115, 116 each include legs 120, 121 carrying a respective male fastening element in the form of a bifurcated projection or stem 122 and a female connecting element in the form of a pintle or trunion 123. The stems or projections 122 of the brackets 115, 116 are directed opposite one another (FIG. 3), whereas the pintles 123 of the brackets 115, 116 are adjacent each other, as is best illustrated in FIG. 1.

The rails 21 through 24 likewise include elongated hollow tubes or bars 130 into the oppositely opened ends of each is seated elements 131 carrying hooks 132 opening in the same direction. The rails 17, 18 and 21 through 24 are secured selectively to the connectors 13 and/or 14 and/or 15 and/or 16 and/or to each other in the manner readily apparent from FIG. 2 in the following preferred sequence:

The rail 21 is connected by its hooks 132 to the pintles of the connectors 15, 16.

The rail 24 is connected by its hooks 132 to the pintles of the connectors 13, 14.

Figure 2:
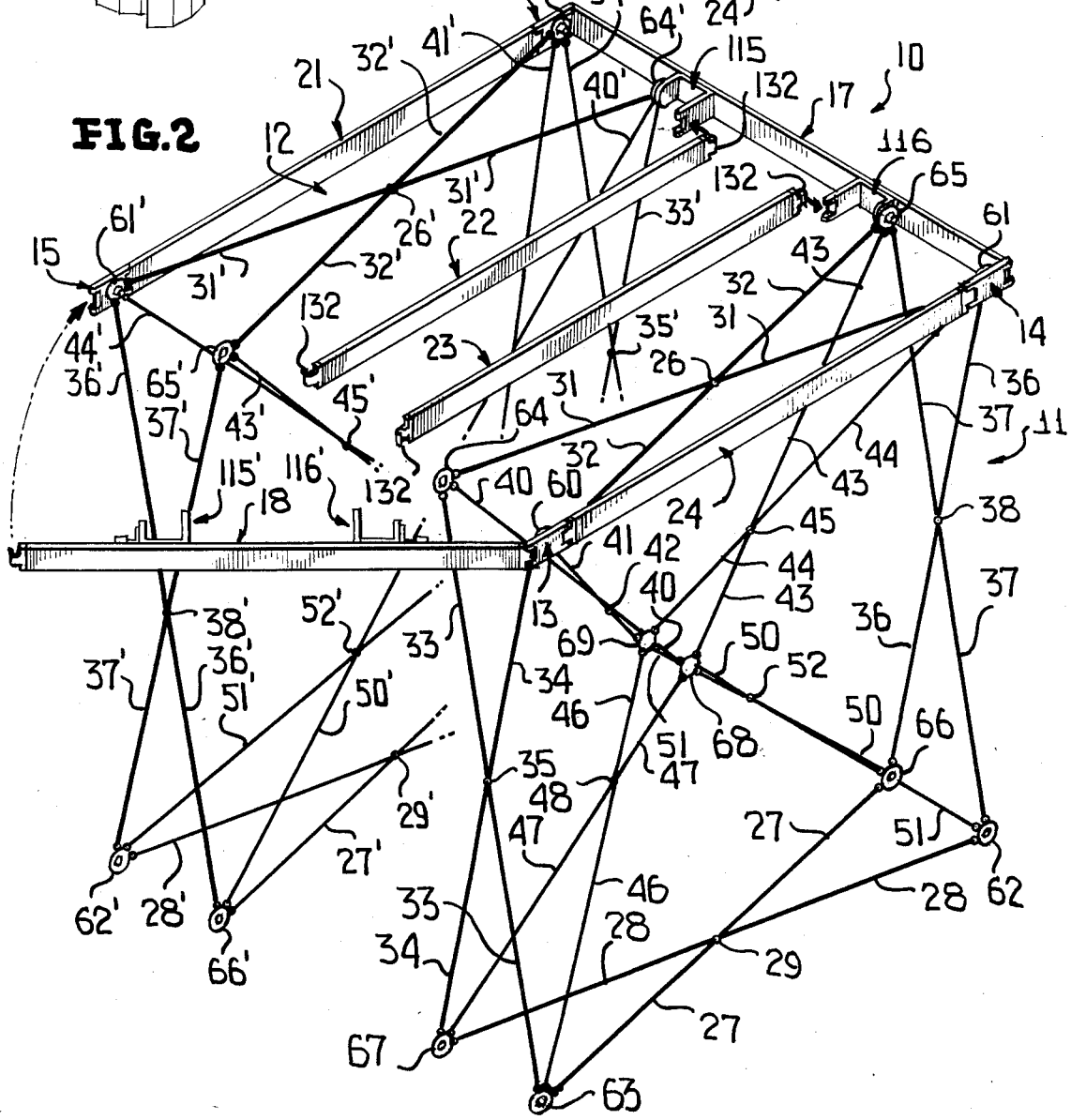
FIG. 2 is a schematic perspective view illustrating the two frames in their erected side-by-side position and the manner in which the various rails are connected thereto and to each other.

The rail 17 is connected in spanning relationship to the frames 11, 12 by connecting the hooks 113, 114 to the pintles of the connectors 16, 14, respectively. The stems 122 of the brackets 115, 116 are connected to the respective hubs 64', 65 of the frames 12, 11, (FIG. 2).

The rail 18 is connected in spanning relationship between the frames 11, 12 by connecting the hooks 113', 112' to the pintles of the respective connectors 15, 13. Thereafter the stems 122' of the brackets 115', 116' are connected to the hubs 65', 64 of the respective frames 12, 11.

The latter described connections completely bound the upper periphery of the knock-down support 10 at all four sides to impart a generally rectangular configuration thereto, as is most evident from FIG. 3 of the drawings.

Thereafter the rails 22, 23 are connected by their hooks 132 to the pintles 123, 123' of the brackets 115, 116 and 115', 116' which positions the rails 22, 23 in spaced parallel relationship to each other and to the outboard adjacent rails 21, 24, respectively. The distance between the rails 22, 23 corresponds to the distance between ends or end faces 141, 142 (FIG. 1) of a plurality of identical ledges or projections 140 of which only one is illustrated at FIG. 1. Preferably, three such ledges or projections 140 are provided at the underside of the table top 25 at its opposite ends and generally medial thereof thereby providing three such projections 140 which are carried by the table top 25. When the table top 25 is unrolled and placed in spanning relationship over and upon the upper edges of all of the rails 17, 18 and 21 through 24, the ledges or projections 140 will project down into and between the rails 22, 23 thereby confiningly locating the table top 25 accurately atop the support in the manner best illustrated in FIG. 5 of the drawings.

The table top 25 is preferably formed from a single sheet 150 of flexible material to which a plurality of narrow slats 151 are adhesively bonded, as is most readily apparent in FIG. 4 of the drawings. This permits the table top 25 to be readily rolled and unrolled between its position of storage (FIG. 1) and its position of use (FIGS. 3 and 5).

If desired, two or more of the knock-down supports or tables 10, 10 can be positioned adjacent each other (FIG. 7) and stand by a single table top 25' identical to the table top 25 but essentially twice as long and having two sets of the projections or ledges 140' therebeneath which function not only to maintain the table top 25' in spanning relationship to both of the supports 10, 10, but also to maintain the supports 10, 10 adjacent one another in the absence of interconnecting the same in any fashion. Thus, the overall surface area of the basic support 10 (FIGS. 1 through 6) can be increased in multiple units merely by duplicating these supports 10 and disposing the same in adjacent side-by-side relationship.

Although only a preferred embodiment of the invention has been specifically illustrated and described herein, it is to be understood that minor variations may be made in the apparatus without departing from the spirit and scope of the invention, as defined in the appended claims.

What is claimed is:

1. A knock-down support comprising a pair of frames, each frame being constructed from a plurality of interconnected relatively movable rods, each frame being foldable from a collapsed inoperative condition to an erected operative condition in generally spaced upstanding adjacent relationship to each other, each frame including a pair of upper corners the upper corners of said frames being generally aligned to define a pair of frame connecting corners, a rail spanning each pair of frame connecting corners, means for removably connecting each rail to its associated pair of frame connecting corners to thereby stabilize said frames in the erected operative condition thereof each frame including a second pair of upper corners, another rail spanning each second pair of upper corners, and other means for removably connecting each another rail to its associated second pair of upper corners.

2. The knock-down support as defined in claim 1 wherein said other removable connecting means include cooperative male and female connecting elements.

3. The knock-down support as defined in claim 1 wherein said other removable connecting means include cooperative male and female connecting elements, said male elements being hooks and said female elements including pintles engaged by said hooks.

4. The knock-down support as defined in claim 1 wherein said other removavle connecting means include a separate connector at each of said second pair of upper corners, means for pivotally connecting selected ones of said rods to each of said separate connectors, each separate connector defining a pintle, and each another rail carrying a hook engaging an associated pintle.

5. A knock-down support comprising a pair of frames, each frame being constructed from a plurality of interconnected relatively movable rods, each frame being foldable from a collapsed inoperative condition to an erected operative condition in generally spaced upstanding adjacent relationship to each other, each frame including a pair of upper corners, the upper corners of said frames being generally aligned to define a pair of frame connecting corners, a rail spanning each pair of frame connecting corners, means for removably connecting each rail to its associated pair of frame connecting corners to thereby stabilize said frames in the erected operative condition thereof, said removable connecting means including cooperative male and female connecting elements, means pivotally connecting selected ones of said rods to selected ones of said male and female connecting elements, each frame including a seond pair of upper corners, another rail spanning each second pair of upper corners, and other means for removably connecting each another rail to its associated second pair of upper corners.

6. The knock-down support as defined in claim 5 wherein said other removable connecting means include cooperative male and female connecting elements, said male elements being hooks and said female elements including pintles engaged by said hooks.

7. The knock-down support as defined in claim 5 wherein said other removable connecting means include a separate connector at each of said second pair of upper corners, means for pivotally connecting selected ones of said rods to each of said separate connectors, each separate connector defining a pintle, and each another rail carrying a hook engaging an associated pintle.

8. A knock-down support comprising a pair of frames, each frame being constructed from a plurality of interconnected relatively movable rods, each frame being foldable from a collapsed inoperative condition to an erected operative condition in generally spaced upstanding adjacent relationship to each other, each frame including a pair of upper corners, the upper corners of said frames being generally aligned to define a pair of frame connecting corners, a rail spanning each pair of frame connecting corners, means for removably connecting each rail to its associated pair of frame connecting corners to thereby stabilize said frames in the erected operative condition thereof, said removable connecting means including a cooperative pair of male and female connecting elements carried by each rail and a female connecting element carried by each frame at each frame connecting corner, means for pivotally connecting selected ones of said rods to said female connecting elements, each frame including a second pair of upper corners, another rail spanning each second pair of upper corners, and other means for removably connecting each another rail to its associated second pair of upper corners.

9. The knock-down support as defined in claim 8 wherein said other removable connecting means include cooperative male and female connecting elements, said male elements being hooks and said female elements including pintles engaged by said hooks.

10. The knock-down support as defined in claim 8 wherein said other removable connecting means include a separate connector at each of said second pair of upper corners, means for pivotally connecting selected ones of said rods to each of said separate connectors, each separate connector defining a pintle, and each another rail carrying a hook engaging an associated pintle.

11. A knock-down support comprising a pair of frames, each frame being constructed from a plurality of interconnected relatively movable rods, each frame being foldable from a collapsed inoperative condition to an erected operative condition in generally spaced upstanding adjacent relationship to each other, each frame including two pairs of upper corners with each pair being defined by inner and outer upper corners, said upper corners of said frames being generally alinged with inner upper corners of said frames being adjacent each other and outer upper corners of said frames being remote from each other, a rail spanning each of said upper corners, first means for removably connecting each rail to its associated inner upper corners, and second means for removably connecting each rail to its associated outer upper corners.

12. The knock-down support as defined in claim 11 including means for effecting locking of each frame in the erected operative condition thereof.

13. The knock-down support as defined in claim 11 including means for effecting self-locking of each frame in the erected operative condition thereof.

14. The knock-down support as defined in claim 11 wherein said first removable connecting means include cooperative male and female connecting elements.

15. The knock-down support as defined in claim 11 wherein said second removable connecting means include cooperative male and female connecting elements.

16. The knock-down support as defined in claim 11 wherein said first and second removable connecting means both include cooperative male and female connecting elements.

17. The knock-down support as defined in claim 11 wherein said second removable connecting means include cooperative male connecting elements carried by said rails and female connecting elements carried by said frames at said outer upper corners.

18. The knock-down support as defined in claim 11 wherein said second removable connecting means include cooperative male connecting elements carried by said rails and female connecting elements carried by said frames at said outer upper corners, said male connecting elements are hooks and said female connecting elements include pintles.

19. The knock-down support as defined in claim 11 wherein said second removable connecting means include cooperative male connecting elements carried by said rails and female connecting elements carried by said frames at said outer upper corners, said female connecting elements each include a separate connector carrying a pintle and a post, a ring at each outer upper corner, means pivotally connecting other selected ones of said rods to said rings, said posts being received in said rings, and said male connecting elements being hooks engaging said pintles.

20. The knock-down support as defined in claim 11 wherein said frist removable connecting means include cooperative male connecting elements carried by said rails and female connecting elements carried by said frames at said inner upper corners.

21. The knock-down support as defined in claim 20 wherein said second removable connecting means include cooperative male connecting elements carried by said rails and female connecting elements carried by said frames at said outer upper corners.

22. The knock-down support as defined in claim 11 wherein said first removable connecting means include cooperative male connecting elements carried by said rails and female connecting elements carried by said frames at said inner upper corners, means pivotally connecting selected ones of said rods to said female connecting elements, and said female connecting elements are rings.

23. The knock-down support as defined in claim 22 wherein said second removable connecting means include cooperative male connecting elements carried by said rails and female connecting elements carried by said frames at said outer upper corners.

24. The knock-down support as defined in claim 11 wherein said first removable connecting means include cooperative male connecting elements carried by said rails and female connecting elements carried by said frames at said inner upper corners, and means pivotally connecting selected ones of said rods to said female connecting elements.

25. The knock-down support as defined in claim 24 wherein said second removable connecting means include cooperative male connecting elements carried by said rails and female connecting elements carried by said frames at said outer upper corners.

26. The knock-down support as defined in claim 25 wherein said last-mentioned male connecting elements are hooks, and said last-mentioned female connecting elements include pintles.

27. The knock-down support as defined in claim 26 wherein said last-mentioned female connecting elements each include a separate connector carrying said pintles and a post, a ring at each outer upper corner, means pivotally connecting other selected ones of said rods to said rings, said posts being received in said rings, and said male connecting elements being hooks engaging said pintles.

* * * * *